US006962307B1

(12) United States Patent
Scheurer

(10) Patent No.: US 6,962,307 B1
(45) Date of Patent: Nov. 8, 2005

(54) ROTATING STATION FOR REELS

(75) Inventor: Paul Scheurer, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/831,202

(22) PCT Filed: Nov. 2, 1999

(86) PCT No.: PCT/CH99/00512

§ 371 (c)(1),
(2), (4) Date: Jul. 18, 2001

(87) PCT Pub. No.: WO00/28118

PCT Pub. Date: May 18, 2000

(30) Foreign Application Priority Data

Nov. 11, 1998 (DE) ..... 198 51 898

(51) Int. Cl.[7] ..... B65H 19/00

(52) U.S. Cl. ..... 242/559.1; 242/559.3; 414/911

(58) Field of Search ..... 242/559, 559.1, 242/559.3; 414/911

(56) References Cited

U.S. PATENT DOCUMENTS

| | | | | |
|---|---|---|---|---|
| 2,735,538 A | * | 2/1956 | Boehm | 242/559 |
| 3,695,539 A | * | 10/1972 | Lindstaedt | 242/559 |
| 4,386,741 A | * | 6/1983 | Weiss et al. | 242/559.3 |
| 4,684,307 A | | 8/1987 | Lattion et al. | 414/31 |
| 4,708,300 A | * | 11/1987 | Goetz | 242/559 |
| 5,141,095 A | | 8/1992 | Kamp | 198/409 |

FOREIGN PATENT DOCUMENTS

| | | |
|---|---|---|
| DE | G9111871.9 | 11/1992 |
| DE | 4225417 | 3/1993 |
| DE | 19720545 | 11/1998 |
| EP | 406923 | 1/1991 |
| EP | 454979 | 11/1991 |
| JP | 52-25125 | 2/1977 |
| JP | 54-8184 | 4/1979 |
| JP | 61-145082 | 7/1986 |
| JP | 3-269120 | 11/1991 |

OTHER PUBLICATIONS

Patent Abstracts of Japan, 61145082 Published Jul. 1986.
Patent Abstracts of Japan 03269120 Published Nov. 1991

* cited by examiner

*Primary Examiner*—John Q. Nguyen
(74) *Attorney, Agent, or Firm*—Francis C. Hand; Garella, Byrne, Bain, et al

(57) ABSTRACT

The invention relates to a method for changing the winding-off direction of reels (W,W1) which are delivered in succession by a delivery station (1) in order to form a reel group (WG) in which the front faces of adjacent reels (W) are equally spaced (a) and the longitudinal axes (LA) of the reels (W) are in a line. In practice, it is sometimes necessary to arrange the preparation machine for producing a reel (W) in such a way in relation to the combing machine group being used that the reels that are delivered by the preparation machine have a different winding-off direction in the ejected winding-off direction to that necessary for the subsequent combing machine. It is therefore necessary to rotate the reels (e.g. 90° or 180°) while preserving the division of the reel group. To this end, the reels (w) that are delivered by the delivery station (1) (W) are gradually shifted crosswise to their direction of delivery by a receiving element (41, 42) of a rotating device (30), by which means they come to lie in a plane in which the longitudinal axis (LA) of the reel (W) lies, are rotated and can then be moved out of the area of the receiving element (42) in the direction of its longitudinal axis (LA).

3 Claims, 4 Drawing Sheets

ROTATING STATION FOR REELS

The invention relates to a method for changing the unwinding direction of wound laps supplied temporally successively from a delivery station in order to form a group of wound laps in which the face sides of adjacent wound laps have the same distance and the longitudinal axes of the wound laps are disposed in one line. The invention similarly relates to apparatuses for rotating a wound lap in a plane transversally to its longitudinal axis, with the respective apparatus being provided with a rotational shaft.

The wound laps (e.g. lap rolls) which are produced in a preparatory machine are produced by winding a web on an empty bobbin and are then ejected from the preparatory machine by producing a breaking.

In order to supply the preparatory machine with textile material (e.g. slivers) several rows are provided to the feed table of the preparatory machines. These cans are filled by draw frames which are provided upstream of the preparatory machines and thereafter moved by way of conveying systems or by hand to the feed table of the preparatory machine.

In order to keep the paths of transport small and to thus minimize the time applied for the transport of the cans, the preparatory machine, or its feed table respectively, must be associated with the can parking places in accordance with the upstream machines (draw frames).

In order to transfer the wound laps which are produced in the preparatory machine in a group via a transport system to downstream combing machines, the wound laps ejected by the preparatory machine are received by a conveying device and compiled step by step into a group of wound laps, with adjacent wound laps being disposed at a similar distance from one another. Such a device is shown for example in JP-52-25 125, with the wound laps supplied by the preparatory machine being discharged transversally to the delivery place via a conveyor belt and being compiled into a group of wound laps. This group is then transferred by means of a conveying system which is guided on a craneway to the respective combing machine. A similar device is disclosed in DE-197 20 545.3.

In the aforementioned embodiments, the group of wound laps which is compiled in the preparatory machine is received by a transport system and deposited close to the respective combing machine, with the ends of the wound web being aligned in such a way that the wound laps are provided in the desired unwinding direction.

In order to adapt the flow of material within the spinning mill according to the local conditions, it may occur that the adjacent row of combing machines is disposed offset by 90° or 180° to the provided group of wound laps with respect to the aforementioned embodiments. In this case the end of the wound lap would face in the wrong direction following the transfer of the wound lap in the aforementioned manner and the wound lap would be present offset by 90°. This means that the unwinding direction of the wound laps placed on the combing machine would be facing opposite to the desired unwinding direction and the wound laps would therefore not be present in the desired unwinding direction.

In this case it is necessary to turn the wound laps in a plane of its middle axis in order to obtain the desired unwinding direction.

An apparatus is known from JP-54-8184, with the wound lap which is ejected by the preparatory machine being transferred to a trough plate which is in connection with a rotating and lifting device. In this device the trough plate is made to rotate by means of an angular gear, with a lifting movement being produced simultaneously with the help of a crank guide. As soon as the wound lap has been twisted (which in this case is 90° in the horizontal direction), it can be received by the grasping arms of a conveying system.

The arrangement shown is highly complex and is not suitable to form a group of wound laps with respectively aligned lap ends.

A device is known from EP-A2-406 923, with an apparatus being provided in order to change the orientation of thread packages. This device is also highly complex and not provided or suitable to produce an even group of wound laps.

The arrangement shown is highly complex and is not suitable to form a group of wound laps with respectively aligned lap ends.

A device is known from EP-A2-406 923, with an apparatus being provided in order to change the orientation of thread packages. This device is also highly complex and not provided or suitable to produce an even group of wound laps.

The invention is therefore based on the object of providing a method and an apparatus which allows changing the orientation of the lap ends after delivery from a preparatory machine, with the subsequent formation of a regular group of wound laps for transfer to a downstream conveying system being ensured.

This object is achieved on the one hand by a method, with the wound laps which are supplied by the delivery station are turned by at least 90° in a plane in which the longitudinal axis of the wound lap is disposed and with the laps being displaced thereafter step-by-step in the direction of their longitudinal axes.

It is further proposed to displace the wound laps supplied by the delivery station step-by-step transversally to their direction of delivery by way of a receiver in a rotating apparatus, by means of which they are rotated by 180° in a plane in which the longitudinal axis of the wound lap is disposed and the wound laps are thereafter displaced from the zone of the receiver in the direction of their longitudinal axis.

This allows changing the orientation of the unwinding direction by maintaining the horizontal direction of conveyance for the formation of the group of wound laps. Moreover, said horizontal direction of conversion can be used simultaneously to slide the wound laps directly on to the rotating apparatus.

In order to protect the outermost layer of the wound lap it is further proposed that the wound laps are moved before and after the rotating process transversally to their longitudinal axes. This means that the wound laps are lifted off of their conveying device prior to the rotating process and thereafter inserted again.

The invention is further achieved by an apparatus, with means being provided in order to intermittently displace the wound laps which are delivered by the delivery station in intervals transversally to the delivery direction in order to form a group of wound laps in which the face sides of adjacent wound laps are provided with a similar distance and the longitudinal axes of the wound laps are disposed in one line and the apparatus for rotating the wound laps projects at least partly in the displacement zone of the wound laps and is provided with at least two receiving means which face in the opposite direction.

This apparatus allows supplying the wound laps during their stepwise transport movement directly to the rotating device and to grasp the same by said device in order to change the orientation of the unwinding direction.

The means for the stepwise displacement can consist of a conveyor belt which is driven by way of a controlled drive. This ensures that on the one hand there are no collisions during the transport of the wound laps and on the other hand an exactly aligned group of wound laps is provided for transfer to a conveying system.

It is preferably proposed to provide the rotating apparatus with a lifting device.

In order to limit the transversal conveying device to provide a group of wound laps to the required amount and to maintain the lateral distances between the wound laps in the group of wound laps, it is proposed that the smallest distance between the rotational shaft of the apparatus and the face side of the would lap pushed completely onto the receiving means corresponds to half the distance between the face sides of adjacent wound laps within the group.

It is preferably proposed that the rotating apparatus rotates the wound lap by 180' and moves it by an angular division, as seen in the direction of displacement of the wound laps, according to the predetermined distances of adjacent wound laps within the group.

In order to ensure the positioning of the wound lap during the rotating movement on the rotating apparatus it is proposed that the receiving means are provided at least partly with a non-slip cover.

An apparatus is further proposed for achieving the object in accordance with the invention, with the approximately vertically aligned rotational shaft of the receiver being disposed outside of the bearing surface of the wound lap in order to transfer the wound lap to a transfer position from which it is supplied by transfer means to a subsequent means for producing a group of wound laps in which the face sides of adjacent laps have the same distance and whose longitudinal axes are disposed in one line.

A further embodiment of the invention is proposed, with the rotational shaft of the receiver being arranged, as seen from the delivery direction of the wound lap from the delivery station, to the right or left outside of the zone which is disposed between the vertical planes in which the face sides of the wound lap are disposed. This arrangement provides a constructionally simple possibility of transfer of the wound lap receiver to a delivery position to a downstream means for forming a group of wound laps.

A method is further claimed according to the main claim, with the wound laps supplied by the delivery station being received by a rotating apparatus and being transferred in the horizontal direction to a downstream longitudinal conveyor, with the wound laps being rotated during their horizontal movement or directly before the delivery to the longitudinal conveyor about an angle in a plane in which the longitudinal axis of the respective wound lap is disposed.

This apparatus allows attaching the storage trough of the preparatory machine in a fixed manner and to perform the transfer to a downstream longitudinal conveyor with the rotating apparatus. This allows a simple constructional design. This means that the rotating apparatus also assumes the task of the transport of the wound laps in addition to the rotation of the wound lap.

In order to protect the wound lap, and its outermost layer in particular, it is proposed to vertically move the wound lap before and after the rotating process, so that it rests freely in the rotating apparatus after the rotating and conveying process.

In order to obtain a certain assignment to the downstream combing machines it is proposed to rotate the wound laps by 90°. In this way the downstream combing machines can be arranged in their longitudinal direction parallel to the direction of ejection of the preparatory machine, which in a number of cases is very advantageous for the downstream flow of material.

The invention is also achieved by an apparatus, with said apparatus being held horizontally displaceable in a guide element for rotation of the wound lap about a vertical rotational shaft and being provided with at least one receiving means for receiving a wound lap which has been supplied by a preparatory machine. The receiving means is fixedly connected with the rotational shaft of the apparatus in order to transfer the received wound lap to a downstream means for producing a group of wound laps.

It is preferably proposed that the apparatus turns the wound lap by approx. 90° and the means for forming the group of wound laps is arranged in such a way that the direction of displacement of the wound laps or the longitudinal direction of the means is aligned approximately parallel to the delivery direction of the delivery station.

It is further proposed that the apparatus is provided with at least four receiving means which project outwardly from its rotational shaft, with at least two of the receiving means being disposed in one line. It is possible with this cross-shaped arrangement of the receiving means to rotate the rotational shaft of the apparatus in only one rotational direction, thus enabling a substantial simplification of the rotational drive. It is thus no longer necessary to perform a reversing movement in order to again receive a subsequent wound lap provided by the preparatory machine. In this arrangement it is also advantageous to provide the receiving means with a non-slip layer in order to prevent any slippage of the wound lap during the transport.

Further advantages of the invention are explained in closer detail by reference to the enclosed embodiments, wherein.

Figure 1:
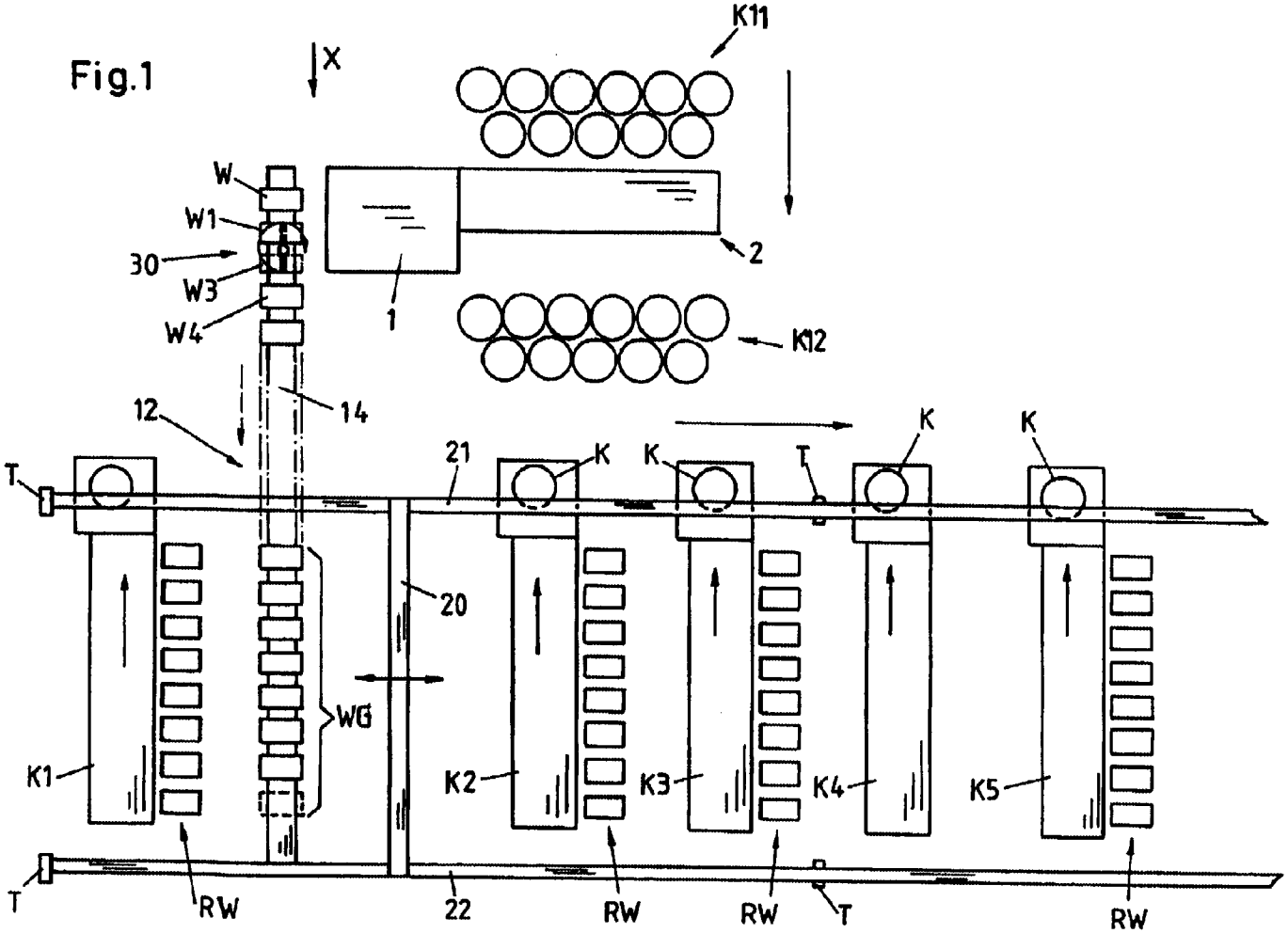
FIG. 1 shows a schematic top view of a combing section of a spinning mill.
Figure 2:
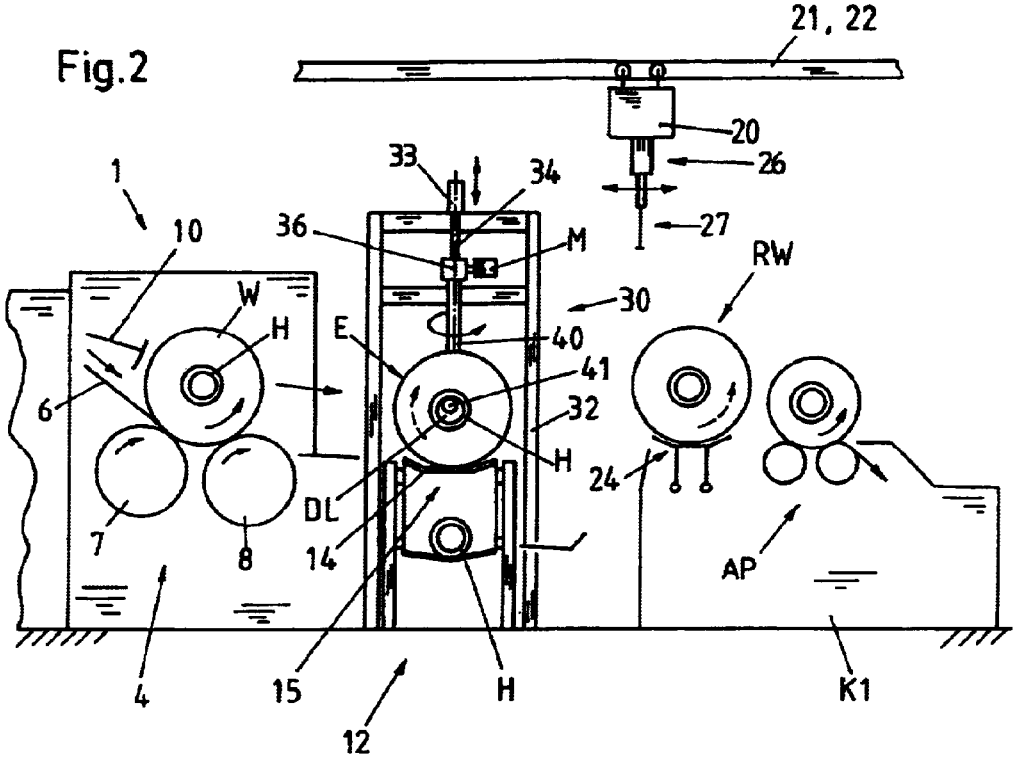
FIG. 2 shows an enlarged side view X according to FIG. 1.

FIG. 1 shows a combing section of a spinning mill with a preparatory machine 1 on which lap rolls W (hereinafter referred to as wound laps) are produced. The preparatory machine 1 is provided with a feed table 2 to which rows of cans K11 and K12 are assigned. The slivers withdrawn from the cans are supplied to drafting arrangements (not shown) and drafted into nonwovens. The nonwovens are placed on top of one another on the feed table 2 and supplied jointly to a winding apparatus 4 (FIG. 2). Before the web 6 thus produced is supplied to the winding apparatus 4, it is guided through calender rollers (not shown in closer detail). The wound lap W produced in the winding apparatus 4 through lap rollers 7 and 8 is ejected backwardly by means of a needle 10. During this process the web 6 is severed, with the end E placing itself on the outer circumference of the wound lap. During the ejection process in the direction of the arrow, the wound lap W is transferred to a trough 15, of a conveyor belt 14 which is a part of a transverse conveying device 12.

Figure 3:
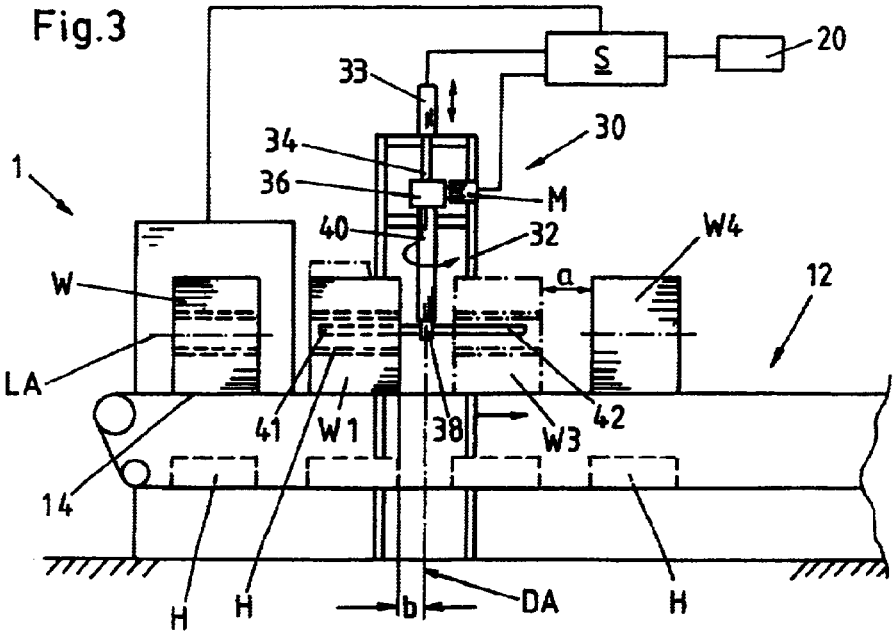
FIG. 3 shows a side view according to FIG. 2.

The wound laps W which are placed on the conveyor belt 14 are displaced step-by-step in the direction of the arrow and combined into a group of wound laps WG. The cross conveyor 12 extends into the zone of movement of a displacement bridge 20 which is guided overhead on rails 21 and 22. The rails 21 and 22 rest on the floor on schematically shown beams T. As is indicated by a double arrow, the displacement bridge 20 can move along rails 21 and 22 in both directions and is driven by a drive source (not shown in closer detail) which on its part is controlled by a control apparatus which is schematically shown in FIG. 3.

Combing machines K1 to K5 are arranged in a row behind one another parallel to the cross conveyors 12, which combing machines are also driven over by the displacement bridge 20. The individual combing machines K1 to K5 are provided with swivellable troughs 24 on which rest a group of eight reserve wound laps RW on standby for follow-up to a working position AP.

As is shown in FIG. 2 in particular, the wound laps W are wound up on a tube H which is provided with clearance DL.

As is shown schematically in FIG. 2, a height-adjustable gripper beam 26 is attached to the displacement bridge 20, which gripper beam is provided with individual gripper arms 27 which can be swivelled into the clearance DL of tubes H for receiving the wound laps.

The slivers which are produced in the individual combing heads (usually eight) of the combing machines are transferred in the direction of the arrow to a drafting arrangement (not shown) of the individual combing machine and joined into a combed sliver which is deposited in schematically shown cans K. The cans K are ejected after filling and transferred by hand or a conveying device for further processing to downstream machines schematically shown in the direction of the arrow.

The placement of the combing machines to the preparatory machine 1 as shown in FIG. 1 can be obtained by respective requirements in the material supply and discharge.

The choice of this placement leads to the consequence that the unwinding direction of the wound lap W as ejected by the preparatory machine with respect to the downstream further conveyance to the combing machines K1 to K5 is present in the wrong direction. This is shown in particular in FIG. 2. The wound lap W which is ejected to trough 15 shows a clockwise unwinding direction, whereas the backup wound lap RW which rests on trough 24 requires an anti-clockwise unwinding direction. This is shown in particular in the illustration of the wound lap which is situated in the working position AP. It is therefore necessary that the wound laps W which are supplied by the preparatory machine 1 are rotated by 180° prior to being received by the displacement bridge 20. This occurs in a rotating station 30 which will be explained in closer detail by reference to FIGS. 2 and 3. The rotating station 30 is provided with a frame 32 which rests on the floor and is fastened there. A cylinder 33 is fastened to frame 32 whose piston rod 34 is fastened to a gearbox 36. A motor M is flange-mounted on the gearbox 36, which motor M drives a transmission stage (not shown in closer detail) within the gearbox casing 36. A drive element of said gear stage is torsionally rigidly connected with a shaft 38 which is rotatably held in pipe 40. The pipe 40 is torsionally rigidly flange-mounted on the gearbox casing 36 and is guided in the vertical direction in the frame 32. Two receivers 41 and 42 which face in opposite directions are fastened to the lower end of shaft 38. The receivers 41 and 42 can be arranged as shafts which are provided with a non-slip layer for example so that the wound laps received from the respective receiver maintain their position during the rotation. The distance b from the middle axle DA of the rotating station 30 to the face side of the wound lap W1 corresponds to half the distance a between the adjacent wound laps of a group of wound laps WG. The consequence is that the wound lap W1, following the performed rotating process by 180° to the position as shown in the dot-dash line, is positioned in such a way that the distance a to the previously rotated wound lap W4 is maintained.

As is shown schematically, the empty tubes H are conveyed back to the preparatory machine 1 on the inner strand of the conveyor belt 14. A detailed description of this device is explained for example in
DE-A1-197 20 545.3.

The mode of operation of the rotating device 30 is explained in closer detail below:

As is shown schematically, the empty tubes H are conveyed back to the preparatory machine 1 on the inner strand of the conveyor belt 14. A detailed description of this device is explained for example in
DE-A1-197 20 545.3.

The mode of operation of the rotating device 30 is explained in closer detail below.

The wound lap W as ejected by the preparatory machine 1 reaches the winding position W1 by means of stepwise displacement in the direction of the arrow of conveyor belt 14, with the tube H sliding with its clearance DL over the free end of receiver 41 during said displacement. Once the position has been reached (which is controlled via the pitch advancement), the intermittent movement of the conveyor belt 14 is interrupted. The cylinder 33 is now actuated by a schematically shown control device S and displaces its piston rod 34 in the vertical direction by a predetermined amount. By a respective connection, the gearbox casing 36 and the pipe 40 are lifted with the shaft 38. Simultaneously, the receivers 41 and 42 are also displaced upwardly in the vertical direction, as a result of which the receiver 41 comes to rest on the inner surface of tube H. In the case of a further vertical displacement the wound lap W1 is lifted off of the conveyor belt 14. After reaching the height indicated with a dot-dash line, the motor M is activated by the control unit S and places the gear within the gearbox casing 36 in motion. As a result, shaft 38 and thus also the receivers 41 and 42 are turned in a horizontal plane until a rotational angle of 180° is reached and the wound lap W1 is situated in the winding position W3. Once this position has been reached, the motor M is stopped again and the cylinder 33 is activated by the control unit S. As a result, the piston rod 34 is moved downwardly again, with receiver 41 also performing a downward vertical displacement. This displacement is made until the position as shown in FIG. 3 is reached, with the wound lap W3 resting completely on the conveyor belt 14 and the receiver 41 no longer having any contact with the inner surface of the tube. After performing this rotational process the end of the wound lap is now in the correct unwinding direction for the downstream combining machines. The winding place W1 is empty again and ready for subsequent receiving. Once a new wound lap W has been supplied again by the preparatory machine 1 to the conveyor belt 14, it is displaced again step-by-step by a winding division until the new wound lap is disposed in the winding position W1 again. As a result of this stepwise movement the previously rotated wound lap W3 is displaced to the winding position W4, as a result of which receiver 42 can rotate freely again in order to transfer a downstream wound lap W1 to the winding position W3. Once a complete group of wound laps WG is located in the zone of the receiver by grippers 26 of the displacement bridge 20, a complete group can be received for follow-up to the combing machine K4 for example.

The device proposed herein allows a simple and careful rotation of the wound lap, with the transversal displacement of the wound lap being directly included simultaneously.

Figure 4:
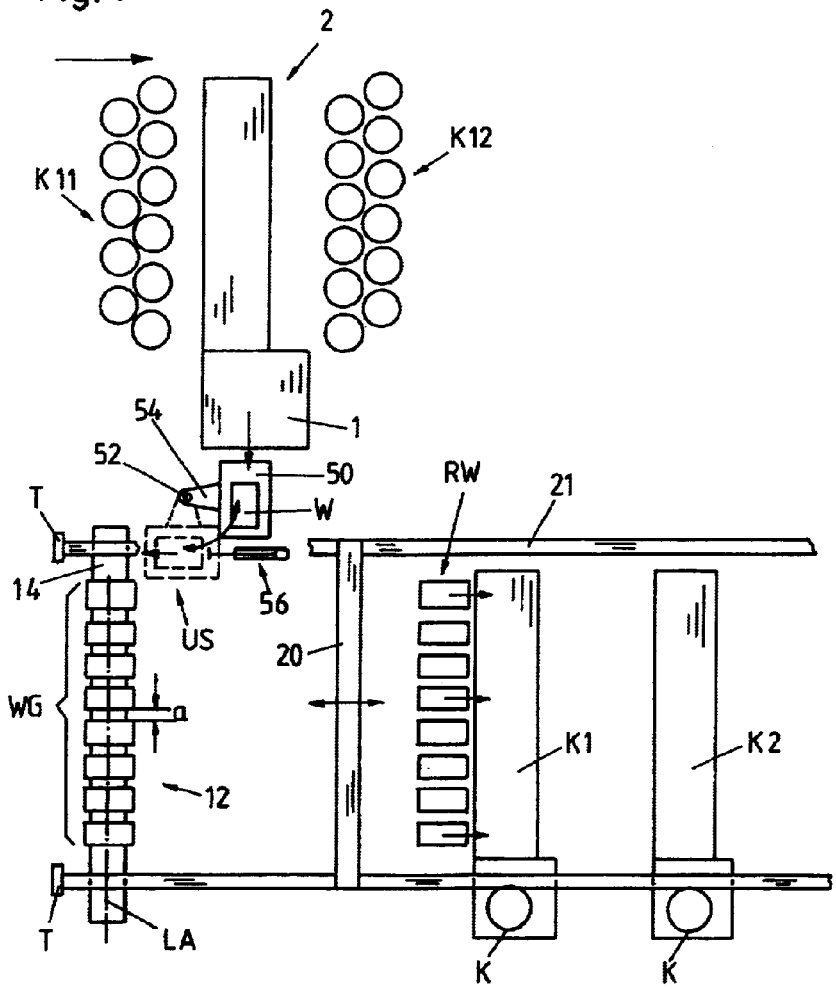
FIG. 4 shows a schematic top view of a combing section of a spinning mill according to FIG. 1 with a further embodiment.

FIG. 4 shows a further installation, with the wound laps RW, which are in reserve in the combing machines, are present offset by 90° to the wound lap W which is ejected from the preparatory machine 1 to a receiving trough 50. This machine line-up can also be obtained by a respective arrangement of the machines which are upstream and downstream of this process stage. The same elements which were described in FIG. 1 are provided with the same reference numerals in FIG. 4 so that the same need not be explained any further.

Only two downstream combing machines K1 and K2 are shown in FIG. 4. In practice, however, at least six combing machines are downstream of a preparatory machine. To ensure that the unwinding direction of the wound laps is correctly provided to the combing machines, a vertical rotational shaft 52 is provided through which the trough 50 with the wound lap W is transferred by arm 54 to a transfer location US (shown with the broken line) by means of arm 54. This swivelling movement is marked with a double arrow.

Once the place of deposit is free on the conveyor belt 14 of the downstream cross conveyor 12 which is opposite of the transfer place US, the wound lap W is transferred by way of a pin 56 (e.g. a cylinder) to the conveyor belt 14. Stops (not shown) can be provided in the zone of the conveyor belt 14 on the cross conveyor 12 in order to limit the rolling path of the wound lap, so that it will come to lie securely on the conveyor belt.

Figure 5:
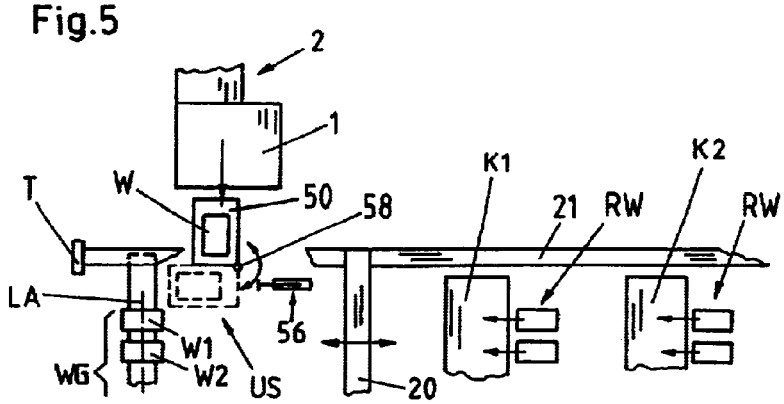
FIG. 5 shows a partial view according to FIG. 4 with a further embodiment.

In the present case a complete group of wound laps WG is present on the cross conveyor 12 for transfer to the displacement bridge 20 and for transfer to a downstream combing machine which reports a demand for wound laps. Once the group of wound laps WG has been removed by the crane bridge 20, the stepwise conveyance of the wound laps W supplied to the conveyor belt 14 for the purpose of the formation of a new group of wound laps WG can be continued, as was already explained above FIG. 5 shows a partial sectional view of an installation. As in the example of FIG. 4 the wound laps are present in the combing machine K1 . . . K2 offset by 90° on the delivery trough 50 of the preparatory machine 1. Furthermore, the combing machines are lined up offset by 180° as compared with the preceding example, so that the winding progress occurs on the downstream combing machines in the opposite direction. This means that the wound lap W must be turned by 90° and the unwinding direction must be turned by 180° as compared with the solution shown in FIG. 4.

For this purpose trough 50 is swivellable about a rotational shaft 58, as is shown with the double arrow. Moreover, the unwinding direction is reversed. The transfer to the conveyor belt 14 of a downstream cross conveyor 12 is also performed in this case by means of a pin 56, as has been explained in the preceding example.

Figure 6:
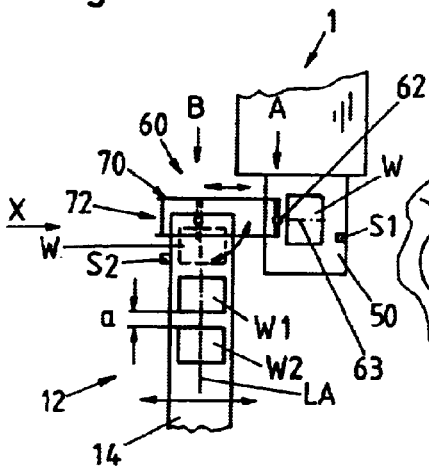
FIG. 6 shows a schematic partial view of a top view of a combing section (FIG. 4) in the delivery zone of the preparatory machine.

FIG. 6 shows a further embodiment, with the wound lap W which is ejected from the preparatory machine 1 being supplied to trough 50. In contrast to the example of FIGS. 4 and 5, the trough 50 is immovably attached. A cross conveying device 12 is arranged parallel and adjacent to the trough 50, with the device having a conveyor belt 14 in order to form a group of wound laps WG (as described above) for a downstream conveying system (not shown).

Figure 7:
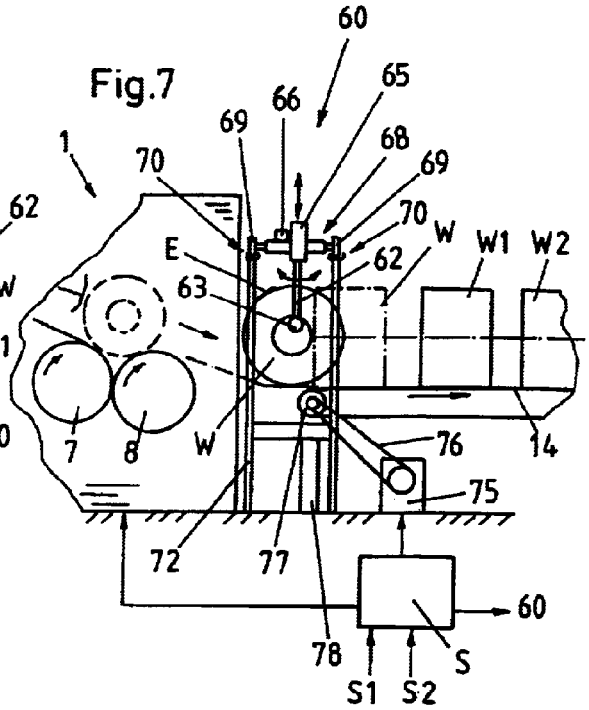
FIG. 7 shows a side view X according to FIG. 6.

In the zone of the transfer between the trough 50 and the shown end of the cross conveyor 12, a rotating station 60 is arranged which is shown in particular in the enlarged side view X of FIG. 7.

The rotating station 60 consists of a frame 72 which rests on the floor. Guide rails 70 are attached to the upper end of the frame 72 on either side, which rails extend transversally to the conveying direction of the cross conveyor 12 and the direction of ejection of the preparatory machine.

Wheels 69 of a carriage 68 run in said guide rails 72. The actual rotating apparatus for the wound laps is rotatably held in said carriage. Carriage 68 is associated with a displacement apparatus which is attached to the frame which is not shown for reasons of clarity of the illustration. Said displacement apparatus could consist of a cylinder for example which acts on the one hand on the frame 72 and on the other hand on carriage 68 in order to perform the horizontal displacement as indicated with the double arrow.

The rotating apparatus consists of a cylinder 65 which is rotatably held (see double arrow) in the carriage 68. The rotational movement of the cylinder 65 is performed by a schematically shown drive 66 which is fastened above the carriage. The cylinder is provided in the shown example with a piston rod 62 which is also designated as a rotating shaft about which the wound lap W is rotated.

A horizontally aligned receiver 63 is attached at the end of the rotational shaft 62, which receiver projects in the shown example into the free space of the tube of the wound lap W resting on trough 50.

As is shown in FIG. 6, sensors S1 and S2 are applied in the zone of the trough 50 and in the end zone of the cross conveyor 12 in order to monitor the presence of a wound lap W or W'.

FIG. 7 further shows a drive 75 which drives the deflection pulley 77 of belt 14 via the drive connection 76. The deflection pulley 77 is held in the frame 78 which rests on the floor.

The drive 75 is controlled through the control unit S which also controls the preparatory machine 1 and the movements of the rotating apparatus 60. The signals S1 and S2 are sent to the control unit S for evaluation.

Based on the position A (FIG. 6) of the rotational shaft 62, the mode of operation of the apparatus is described below:

The control unit S is reported by sensors S2 that no wound lap W' is located any more at the transfer location (shown with the broken line). The wound lap W is lifted by cylinder 65 by means of receiver 63 by a certain amount, so that it no longer rests on trough 50. Thereafter carriage 68, and thus the receiver 63, is displaced to position B by a displacement element (not shown). The rotation of the wound lap by 90° (see double arrow) occurs thereafter by means of the rotational drive 65 and the rotatably held cylinder 65. The wound lap is now lowered by means of cylinder 65 until it rests on the conveyor belt 14. This is then reported by sensor S2 to the control unit S. Once this process is completed, the control unit sends a signal to the drive 75 which puts in motion the deflection pulley 77 and thus the conveyor belt 14 in the direction of the arrow until the new wound lap has been displaced by a respective winding division and sensor S2 reports again that the receiving place on the conveyor belt is once again free. In order to monitor the precise winding movements on the conveyor belt there are further sensors (not shown). During this displacement of the new wound lap via the conveyor belt, the receiver 63 has become free again, as a result of which the same is swivelled back in the opposite rotational direction. From this position (B) the receiver 63 can be displaced via carriage 68 to position A again once the sensor S1 reports that a new wound lap W is present on the trough 50. The described process can thus start anew again. Once a complete group of wound laps WG is present on the cross conveyor 12 it can be received by the conveying system (not shown).

Figure 8:
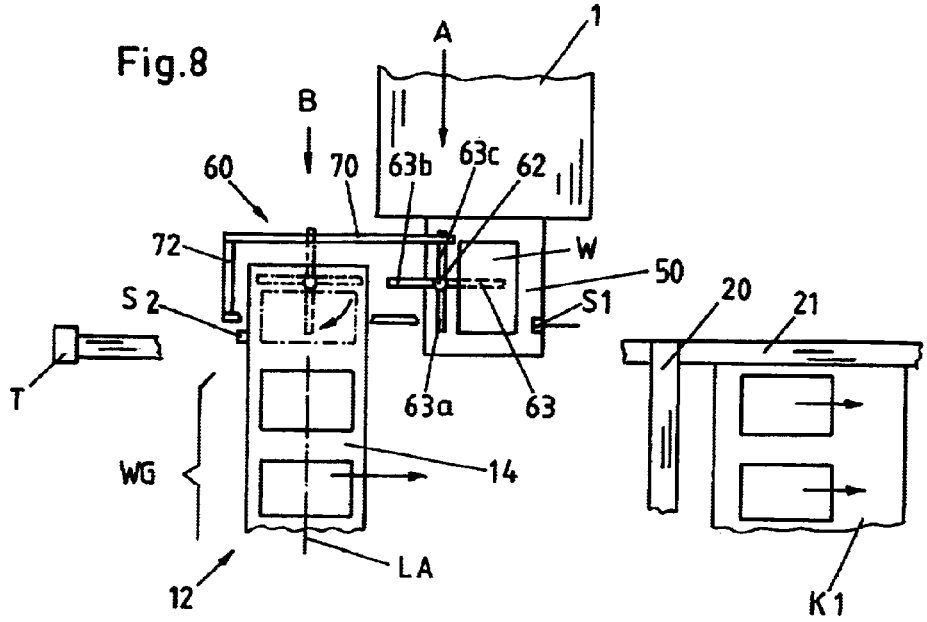
FIG. 8 shows a further embodiment according to FIG. 3 on an enlarged scale.

The embodiment of FIG. 8 corresponds substantially to that of FIG. 6, with only three further receivers 63*a*, 63*b* and 63*c* being fastened to the rotational shaft. This device allows omitting the additional reversing movement of the rotational shaft after the delivery of the wound lap W to the conveyor belt 14, as was necessary in the aforementioned apparatus according to FIG. 6. The other movement sequences are the same, so that they need not be described here again.

Once the wound lap W deposited on the conveyor belt 14 has been further conveyed by a winding division, the rotating apparatus can be displaced in this case (FIG. 8) without any further rotational movement in the direction towards position A in order to receive a new wound lap W there.

With the proposed apparatuses it is possible to provide a simple and flexible adjustment to the different line-ups of the machines in the spinning room, thus always ensuring the correct feed of the wound laps in the combing machines. This concept allows incorporating combing sections in existing plants without having to re-organize the entire machine outfit.

What is claimed is:

1. In combination, a preparatory machine for sequentially delivering wound laps, each wound lap having a longitudinal axis;

a conveying belt disposed transversely of said preparatory machine for sequentially receiving the delivered wound laps;

means for driving said conveying belt in stepwise manner; and means located between said preparatory machine and said conveying belt for sequentially rotating each wound lap 180° in a plane of said longitudinal axis thereof and conveying each wound lap from said preparatory machine onto said conveying belt in coaxially equi-spaced apart relation, said latter means including a rotatable shaft disposed perpendicularly of said conveying belt at one end of said conveying belt, at least two receiving means mounted on opposite sides of said shaft, each said receiving means being positioned to engage a wound lap delivered to said conveying belt and to rotate the engaged wound lap at least 180° onto said conveying belt in response to rotation of said shaft and a lifting device for raising and lowering said shaft relative to said conveyor belt.

2. A method of conveying wound laps comprising the steps of producing a series of wound laps in a winding station, each of said laps having a web wound onto a tube about a longitudinal axis of the tube;

delivering each wound lap successively from said winding station onto a conveyor belt extending in a direction parallel to said axis;

sequentially lifting and rotating each wound lap delivered to said conveyor belt 180° to reverse a winding off direction of the web on the tube thereof;

thereafter depositing each wound lap onto said conveyor belt after said step of rotation;

thereafter driving said conveyor belt in stepwise manner to space the wound laps delivered to said conveyor belt in equi-spaced relation along said conveyor belt; and conveying the wound laps on said conveyor belt in stepwise manner longitudinally of said axis to a series of combing machines.

3. A method as set forth in claim 2 wherein each wound lap is moved transversely of said axis before and after said step of rotating said wound lap.

* * * * *

UNITED STATES PATENT AND TRADEMARK OFFICE

CERTIFICATE OF CORRECTION

PATENT NO. : 6,962,307 B1
DATED : November 8, 2005
INVENTOR(S) : Scheurer

It is certified that error appears in the above-identified patent and that said Letters Patent is hereby corrected as shown below:

Column 3,
Line 18, change "180'" to -- 180º --.

Signed and Sealed this

Seventh Day of February, 2006

JON W. DUDAS
*Director of the United States Patent and Trademark Office*